US008646371B2

(12) United States Patent
Fisher

(10) Patent No.: US 8,646,371 B2
(45) Date of Patent: Feb. 11, 2014

(54) PROTECTION ARMOR

(75) Inventor: Stephen Fisher, Athens (GR)

(73) Assignee: Armortec SA, Athens (GR)

( * ) Notice: Subject to any disclaimer, the term of this patent is extended or adjusted under 35 U.S.C. 154(b) by 521 days.

(21) Appl. No.: 12/808,804

(22) PCT Filed: Dec. 19, 2008

(86) PCT No.: PCT/EP2008/010921
§ 371 (c)(1),
(2), (4) Date: Jun. 17, 2010

(87) PCT Pub. No.: WO2009/080311
PCT Pub. Date: Jul. 2, 2009

(65) Prior Publication Data

US 2011/0036234 A1 Feb. 17, 2011

(30) Foreign Application Priority Data

Dec. 20, 2007 (EP) ..... 07024859

(51) Int. Cl.
*F41H 5/04* (2006.01)

(52) U.S. Cl.
USPC ..... 89/36.02; 89/906

(58) Field of Classification Search
USPC ..... 89/36.02, 906, 907, 908, 909
See application file for complete search history.

(56) References Cited

U.S. PATENT DOCUMENTS

| | | | | | |
|---|---|---|---|---|---|
| 2,718,829 | A * | 9/1955 | Seymour et al. | ..... | 404/31 |
| 3,592,942 | A * | 7/1971 | Hauck et al. | ..... | 89/36.02 |
| 4,665,794 | A | 5/1987 | Gerber et al. | | |
| 5,221,807 | A | 6/1993 | Vives | | |
| 6,575,075 | B2 * | 6/2003 | Cohen | ..... | 89/36.02 |
| 7,543,523 | B2 * | 6/2009 | Hunn | ..... | 89/36.02 |
| 7,866,248 | B2 * | 1/2011 | Moore et al. | ..... | 89/36.02 |
| 2004/0083880 | A1 * | 5/2004 | Cohen | ..... | 89/36.02 |
| 2006/0243127 | A1 | 11/2006 | Cohen | | |
| 2008/0236378 | A1 * | 10/2008 | Sane et al. | ..... | 89/36.02 |

FOREIGN PATENT DOCUMENTS

| | | | | | |
|---|---|---|---|---|---|
| DE | 2 344 222 | | 6/1974 | | |
| DE | 196 43 745 | A1 | 4/1998 | | |
| EP | 1 298 407 | A1 | 4/2003 | | |
| EP | 1 363 101 | A1 | 11/2003 | | |
| GB | 2007256 | A * | 5/1979 | ..... | 89/36.02 |
| GB | 2147977 | A | 5/1985 | | |
| WO | 99/11997 | | 3/1999 | | |

OTHER PUBLICATIONS

International Search Report from corresponding International Application No. PCT/EP2008/010921 dated Apr. 7, 20098.

* cited by examiner

*Primary Examiner* — Stephen M Johnson
(74) *Attorney, Agent, or Firm* — Renner, Otto, Boisselle & Sklar, LLP

(57) ABSTRACT

The present invention relates to improved protection armor for providing protection against high impact projectiles, said armor having improved resistance at a reduced overall weight. The invention further relates to methods of producing such armor and to objects protected by such armor.

19 Claims, 3 Drawing Sheets

PROTECTION ARMOR

The present invention relates to improved protection armor for providing protection against high impact projectiles, said armor having improved resistance at a reduced overall weight. The invention further relates to methods of producing such armor and to objects protected by such armor.

BACKGROUND OF THE INVENTION

Various types of armor are known in the art. The majority of armor produced to date are made of steel, but ceramic armor is also known.

Typically, steel armor is heavier than ceramic armor. Steel armor has a number of significant disadvantages. In the case of body or vehicle armor, higher weight reduces mobility. Heavier armor also tends to be bulkier and less flexible, which is a problem in particular with armored vests.

Also known is armor that employs light-weight materials such as fabrics comprised of aramid fibers, ultra-high molecular weight polyethylene fibers, carbon fibers and liquid crystal polyester fibers, as well as high density, light-weight, hard materials, such as titanium, alumina oxide ceramic, boron carbide ceramic, silicon carbide ceramic, glass ceramic and metal-matrix ceramics, and ultra hard metals. To achieve maximum efficiency, these materials are frequently stacked upon one another to progressively destroy the penetrator. One of the most successful multi-layer types of materials for use against high-energy impacts, such as those caused by high-velocity rifle bullets, employs a strike-face comprising the hardest available material such as light-weight ceramics. The strike-face layer is applied (e.g. by lamination or gluing) upon a stiff energy absorbing material which may be material such as the fabrics mentioned above, or combinations thereof. The most commonly employed material is boron carbide ceramic tiles arranged side by side, in a multiple tile configuration with mating edges affixed to an ultra-high molecular weight polyethylene (UHMWPE) laminate. The thickness and density of both the ceramic and laminate are engineered to be sufficient to defeat the specified threat.

Functionally, when the strike-face of a ceramic tile is impacted, it destroys the penetrative ability of the impactor by radical deformation and, should the impactor have sufficient remaining energy to pass beyond the ceramic tile, the minor remaining energy is absorbed by an underlying laminate. The intimate adhesion of the ceramic to the laminate is of primary importance since unsupported ceramic is by nature brittle and requires a rigid backing support. The absence of such a support would cause the resistance to decrease significantly, leading to failure to meet the desired level of impact-resistance. Another requirement of such a construction is for the mating edges to be placed tightly against one another, in case the impactor strikes the joint of two or more tiles.

Today, ceramic armor is generally of two basic geometries: single large monolithic tiles or smaller tiles arranged in a manner that minimizes gaps between the tiles. In all cases, the ceramic is expected to be penetrated, therefore an energy-absorbing component is integrated behind the ceramic to capture and dissipate the remaining energy of the penetrator and any remnants of the penetrator.

Recent laboratory testing has revealed several interesting mechanical penetration phenomena associated with ceramics under containment by a more ductile material such as steel. Containment in these experiments entails the total encapsulation of a ceramic armor element (usually a tile) by a metal of known impact resistance in a welded construction firmly mounted on a structure of sufficient strength to tolerate the impact of a heavy impactor (usually a long pointed metallic rod) (INTERFACE DEFEAT and PENETRATION: TWO MODES OF INTERATION BETWEEN METALLIC PROJECTILES and CERAMIC TARGETS; LUNDBERG, P.; UNIVERSITY of UPPSALA; 2004.)

Contained ceramic has significantly increased impact resistance than the same ceramic uncontained. In actual practice and application in the field, containment of ceramics in such a manner is impractical except in the largest vehicles or structures.

The measure of the impact resistance is usually characterized by the energy required to penetrate or destroy the material being impacted. In the case of ceramic armor elements, the projectiles typically are lower in hardness than the ceramic element, but with a much higher resistance to brittle fracture. In the field of ceramic armors, it is well known that the ceramic is progressively destroyed by a process known as 'interface defeat' (A DETAILED COMPUTATIONAL ANALYSIS OF INTERFACE DEFEAT, DWELL AND PENETRATION FOR A VARIETY OF CERAMIC TARGETS; T. J. HOLQUIST and G. R. JOHNSON; U.S. ARMY HIGH PERFORMANCE COMPUTING RESEARCH CENTER. September 2002).

Contained ceramic tiles tested in this manner typically exhibit a resistance to penetration approximately 1.3 to 1.8 times that of an uncontained tile (AMPTIAC QUARTERLY VOL. 8 NUMBER 4 2004 ARMY MATERIALS RESEARCH, http://ammtiac.alionscience.com).

Ceramic structures in protection armor typically use have parallel flat surfaces. Recently however, ceramic pellets encapsulated in a metallic or plastic matrix material have been used (EP 1 363 101, U.S. Pat. No. 6,575,075, US 2006/0243127, US 2004/0083880). These systems typically exhibit increased thickness, weight and processing requirements, compared to conventional parallel-surfaced ceramic armor systems.

U.S. Pat. No. 5,221,807 discloses protection armor comprising an armor plate for stopping projectiles with an auxiliary plate disposed in front thereof, the auxiliary plate being constituted by a ceramic plate pierced by a large number of blind holes distributed in a regular mesh extending perpendicularly from the impact side towards the rear side. The effect of the auxiliary plate is to destabilize and to score the projectiles so as to enhance their tendency to shatter on striking the armor plate. The auxiliary plates disclosed in U.S. Pat. No. 5,221,807 are distinguished from armor plates of the present invention in that the multiple depressions of the auxiliary plate are not filled with a second material, and are not sealed by a rigid layer of a third material.

U.S. Pat. No. 4,665,794 discloses an armor plate comprising multiple depressions, which are filled with a plurality of packing bodies in an irregular or regular fashion. The packing bodies are hollow-bodied and consist of a non-metallic material such as glass or ceramic. The interspaces between the packing bodies are filled out with plastic material, preferably polyurethane foam. The armor plate of U.S. Pat. No. 4,665,794 is distinguished from armor plates of the present invention, in that the plates of U.S. Pat. No. 4,665,794 are metal plates, and no rigid layer of a third material is provided.

U.S. Pat. No. 6,575,075 discloses a composite armor construction for absorbing and dissipating kinetic energy from high velocity projectiles. The construction includes an internal layer of pellets, which are bound and retained by a solidified material. The pellets may contain holes which can optionally be filled with a solidified material. The present invention is distinguished from the construction of U.S. Pat.

No. 6,575,075 in that the ceramic material disclosed therein is in form of pellets, and not in form of a rigid monolithic tile. No rigid layer of a third material, fixedly attached to the ceramic plate is disclosed.

GB 2147977 discloses a ceramic tile with a filleted area at its edges designed to strengthen the edges of the tile. The resulting depression is optionally filled with a second material, such as epoxy, polyester or acrylic resin. GB 2147977, however, does not disclose a rigid layer of a third material, sealing the second material between the ceramic tile and the rigid layer.

WO 99/11997 discloses an armor according to the preamble of claim 1. This document, however, does not disclose the characterizing part of the claim, i.e. it does not disclose at least one depression at a side opposite the strike-face of the armor.

SUMMARY OF THE INVENTION

In view of the above described prior art, it is the object of the present invention to provide improved armor having a higher degree of protection against impact and improved security against multiple impact, at a reduced weight.

The present invention relates to armor comprising a ceramic tile, said ceramic tile having a first and a second major surface, said ceramic tile further having at least one depression in said first major surface, said depression being at least partially filled with a second material, said armor further comprising a rigid layer of a third material, said rigid layer being fixedly attached to said first major surface of the ceramic tile and contacting said second material, so as to seal said second material between said ceramic tile and said rigid layer. The ceramic tile is arranged in said armor, such that the second major surface is at the strike-face of the armor.

Surprisingly, tiles of the present invention show improved protective properties as compared to conventional ceramic tiles (of the same thickness), and the weight of the armor can be significantly reduced. This is achieved by replacing some of the ceramic material with a second material.

According to one aspect of the invention, multiple depressions, at least partially filled with a second, preferably lightweight material are provided in the ceramic tile.

Creating thin sections of ceramic from the surrounding thicker material by forming depressions surprisingly does not reduce the impact resistance of the armor. The use of filled depressions results in a lighter, equally resistant ceramic structure without increasing its thickness.

SHORT DESCRIPTION OF THE FIGURES

DETAILED DESCRIPTION OF THE INVENTION

Figure 1:
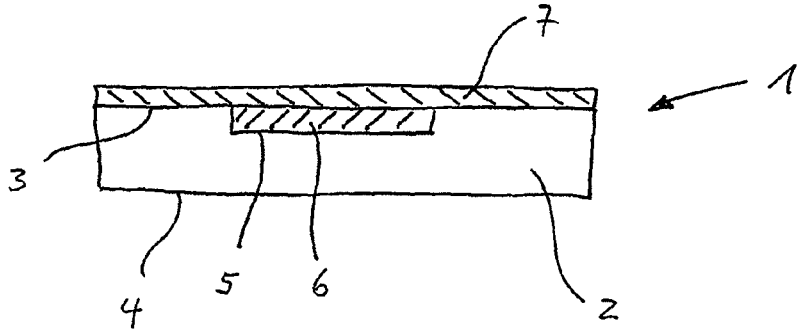
FIG. 1 shows a cross sectional view of an armor of the invention.

"Ceramic material" within the present invention, shall be understood to be a non-metallic, inorganic solid having a crystalline or glassy structure. Preferred ceramic materials within the context of the invention are alumina oxide, boron carbide, silicon carbide, glass ceramics of all formulations, cermets, titanium diboride, silicon oxide, silicon nitride, magnesium oxide, silicon aluminum oxynitride in both alpha and beta form and mixtures thereof, aluminum nitride, metal matrix-ceramics, transformation toughened zirconium dioxide, any ceramic material containing reinforcing fibers or any other refractory material. Other ceramic materials are metallic alloys with a structure at least partially crystalline giving a high hardness with low impact loading.

"Composite material" within the context of the present invention is to be understood as being a material in which two or more dissimilar substances, preferably metals, ceramics, glass, and polymers, are combined to produce structural or functional properties not present in any of the individual components.

A "continuous ceramic material", according to the invention shall be understood to be a ceramic material which extension in space is uninterrupted by other materials.

A "depression" within the context of the present invention, shall be understood to be a deepening, indentation, cavity, or hollow space in the surface of a solid object. A depression, according to the invention can also be an elongated depression, such as a channel.

The "Mohs scale hardness", within the context of the present invention, shall be understood to be the scratch resistance of a material, measured through the ability of a harder material to scratch a softer material. In the present context, the Mohs scale created in 1812 by the German mineralogist Friedrich Mohs applies. This scale is based the scale on ten minerals that are all readily available. As the hardest known naturally occurring substance, diamond is at the top of the scale. The hardness of a material is measured against the scale by finding the hardest material that the given material can scratch, and/or the softest material that can scratch the given material. For example, if some material is scratched by apatite but not by fluorite, its hardness on the Mohs scale would fall between 4 and 5.

TABLE 1

Mohs scale hardness of materials

| Mohs Hardness | Mineral | Absolute Hardness |
|---|---|---|
| 1 | Talc ($Mg_3Si_4O_{10}(OH)_2$) | 1 |
| 2 | Gypsum ($CaSO_4 \cdot 2H_2O$) | 2 |
| 3 | Calcite ($CaCO_3$) | 9 |
| 4 | Fluorite ($CaF_2$) | 21 |
| 5 | Apatite($Ca_5(PO_4)_3(OH^-,Cl^-,F^-)$) | 48 |
| 6 | Orthoclase Feldspar ($KAlSi_3O_8$) | 72 |
| 7 | Quartz ($SiO_2$) | 100 |
| 8 | Topaz ($Al_2SiO_4(OH^-,F^-)_2$) | 200 |
| 9 | Corundum ($Al_2O_3$) | 400 |
| 10 | Diamond (C) | 1500 |

A "monolithic" object, in the present context, is a single continuous piece of material. Preferably, a monolithic object is of a homogeneous material.

A "mesh", within the context of the present invention, is a net, a fabric or a woven material. A mesh can be used to provide a thin cover for armor plates on either or both sides of the armor plate. A mesh of the present invention is preferably made of stainless steel, aluminum or titanium wire but can also be made from polyethylene fibers, such as fibers sold under the trademark DYNEEMA® or tough light aramid synthetic fibers, such as fibers sold under the trademark KEVLAR® or of similar material, to form a multi-layered armored panel.

A "resin", within the present context, is a viscous liquid capable of hardening, or the hardened material thereby obtained. Resins may be obtained by esterification or soaping of organic compounds. A preferred resin of the present invention is epoxy resin, manufactured through polymerization-polyaddition or polycondensation reactions. Another preferred resin is unsaturated polyester resin.

The "Rockwell C hardness", in the context of the present invention, is the indentation hardness of materials through the depth of penetration of an indenter, loaded on a material sample and compared to the penetration in some reference material. In accordance with the present invention, the Rockwell C hardness is the hardness as defined International Standard ISO 6508-1: "Metallic materials, Rockwell hardness test, Part 1", scale C.

By a "strike-face" of an armor is meant the side of the armor which has been designed to tolerate the expected impact. The strike-face will be first struck by the projectile. Within the context of the present patent, for a major surface of a tile to be "at the strike-face of an armor", the tile must be arranged within said armor such that said major surface is directed towards the side of the armor from which the impact or threat, i.e. projectiles, are expected. There may be additional layers in front of said major surface, in the direction of the expected impact, such as layers of flexible material fixedly attached to the ceramic tile.

"Thermosets", according to the invention, are polymer materials that cure, through the addition of energy, to a stronger form. The energy may be in the form of heat (generally above 200 degrees Celsius), through a chemical reaction (two-part epoxy, for example), or irradiation. Thermoset materials are usually liquid or malleable prior to curing, and designed to be molded into their final form, or used as adhesives. The curing process transforms the resin into a plastic or rubber by a cross-linking process. Energy and/or catalysts are added that cause the molecular chains to react at chemically active sites (unsaturated or epoxy sites, for example), linking into a rigid, 3-D structure. The cross-linking process forms a molecule with a larger molecular weight, resulting in a material with a higher melting point. During the reaction, when the molecular weight has increased to a point so that the melting point is higher than the surrounding ambient temperature, the material forms into a solid material. Subsequent uncontrolled reheating of the material results in reaching the decomposition temperature before the melting point is obtained. A thermoset material cannot be melted and re-shaped after it is cured. Thermoset materials are generally stronger than thermoplastic materials due to this 3-D network of bonds, and are also better suited to high-temperature applications up to the decomposition temperature of the material. They do not lend themselves to recycling like thermoplastics, which can be melted and re-molded. Some examples of Thermosets are: Vulcanized rubber, Bakelite, a Phenol Formaldehyde Resin (used in electrical insulators and plastic wear), Urea-formaldehyde foam (used in plywood, particleboard and medium-density fibreboard), melamine resin (used on worktop surfaces), polyester resin (used in glass-reinforced plastics/fibreglass (GRP)), epoxy resin (used as an adhesive and in fibre reinforced plastics such as glass reinforced plastic and graphite-reinforced plastic), polyimides used in printed circuit boards and in body parts of modern airplanes A "tile" within the context of the present invention is an object made of a single continuous piece of ceramic material, said object having an upper (first) and lower (second) surface which are preferably parallel to one another. A tile according to the invention can assume a cuboid form which is significantly (at least 2, 4, 8, 20 times) greater in length and in width compared to its thickness. A tile, according to the invention, however, may also be of a rounded or irregular geometry, provided there are substantially parallel upper and lower surfaces that have substantially greater measures in comparison to the thickness. A curved tile with essentially parallel surfaces is an example.

Referring to FIG. 1, the present invention relates to an armor 1 comprising a tile 2 of a ceramic material, said tile having a first and a second major surface (3 and 4), said ceramic tile 2 further having at least one depression 5 in said first major surface 3, said depression 5 being at least partially filled with a second material 6, said armor 1 further comprising a rigid layer 7 of a third material, said rigid layer 7 being fixedly attached to said first major surface 3 of said tile 2 and contacting said second material 6, so as to seal said second material 6 between said ceramic material and said rigid layer 7.

The first and second major surfaces 3 and 4 may be substantially parallel surfaces, and they may be substantially flat (planar) surfaces.

Preferably, tile 2 is a monolithic tile. The ceramic material may be a continuous ceramic material. Tiles of the invention are preferably of a square, round, triangular, or hexagonal shape. Any other geometry with at least two substantially parallel surfaces can also be applied.

Figure 2:
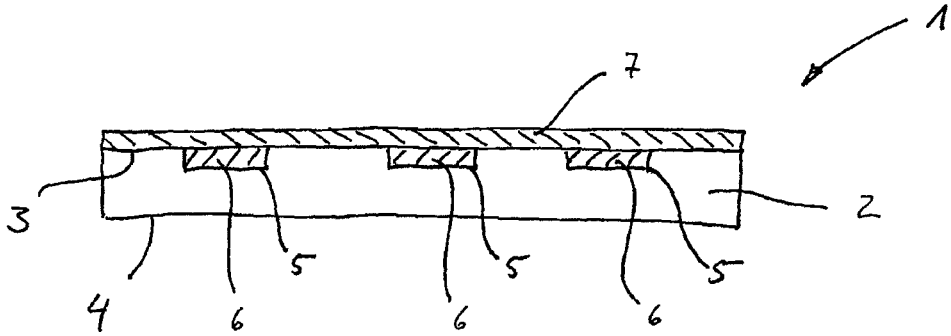
FIG. 2 shows a cross sectional view of an armor element of the invention having multiple depressions.

With reference to FIG. 2, the ceramic tile may have multiple depressions 5 in said first major surface 3. In this case, a tile may comprise at least two, at least four, at least six, at least eight, or at least sixteen depressions.

Preferred armors of the invention comprise a tile 2 having a thickness of 4 to 60 mm, preferably 5 to 30 mm, or 6 to 20 mm, or most preferred 7 to 10 mm.

In preferred armors of the invention, said second major surface 4 is at the (i.e. arranged in the direction of the) strike-face. Hence, said second major surface 4 is facing towards the side of the expected impact.

In preferred armors of the invention, said ceramic material and said second material and said third material are distinct materials.

Preferably, the ceramic material has a Mohs scale hardness of larger than 6, or 7 or most preferred larger than 8. The ceramic material preferably has a Rockwell C hardness greater than 60. Preferably, said ceramic material has a sound wave propagation velocity of greater than 5000 meters per second.

Preferred ceramic materials for tiles of the invention are alumina oxide, boron carbide, silicon carbide, glass ceramics, cermets, titanium diboride, silicon oxide, silicon nitride, silicon aluminum oxynitride, aluminum nitride or transformation toughened zirconium dioxide.

The ceramic material of the tile may contain reinforcing elements, e.g., tungsten fibers.

The second material 6 is a non-gaseous material.

In preferred embodiments of the invention, said second material 6 has a specific weight smaller than that of the ceramic material of the tile. The second material 6 may be a resin, e.g., a polyepoxide, polyether-ether-ketone, polycarbonate, or a liquid crystal polyester. The second material 6 is preferably homogeneous. The second material 6, however, may also be a composite material. It may, e.g., contain a metal mesh and a resin. It may contain multiple layers. In most preferred embodiments, said second material 6 is a material with a Mohs scale hardness analogous to the said first material.

In preferred embodiments of the invention, said at least one depression 5 is completely filled with said second material 6. Completely filled, in this context, means that the depressions are filled with the second material up to a level which is in the same plane as the respective major surface 3 or 4 of the ceramic tile. The second material may also completely fill the said at least one depression and occupy a space above the plane of the major surface 3 or 4 of the ceramic tile.

In preferred embodiments of the invention said second material is fixedly connected to said ceramic material and to said rigid layer of a third material.

The second material 6 may also be a non-newtonian fluid, such as a shear thickening fluid, or may be a gel. The second material 6 may also be a ferro fluid or a magneto-rheological fluid. Several other appropriate materials for filling said depressions are thermoplastic or thermoset plastics, rapid-solidification (RSM) materials, non-newtonian material formulations, inorganic materials in any state, cermets, metals, woven and non-woven materials, multi-layered configurations of any of these materials, or composite formulations of any of these materials.

The third material of the invention is preferably a homogeneous, rigid material. It may be metal, such as aluminum, titanium, or another light-weight metal. The third material may also be any high tensile strength material that when punctured by a projectile does not shatter and allow ejection of either the second or third material from the point of projectile impact—that is a ductile and elastic material such as thermoplastic or thermoset plastic, reinforced or not reinforced.

The third material of the invention may be a composite material. This composite material may be a composite material comprising the second material and additional material. In a preferred embodiment of the invention, the third material comprises the second material and a mesh. Such composite materials provide the strength and rigidity required from a covering layer in the context of the present invention. Strength and rigidity of this composite third material is preferably significantly greater than strength and rigidity of the second material.

The third material can also be a fibrous material or a mesh.

These materials can be individually applied to the ceramic tile 2, filling the depressions 5 and covering the upper and lower tile surfaces or can be formed into individual plugs that when adhered to the mating surface of the depression, adequately provides the desired effect. Alternatively, plugs may be formed directly in the depressions sequentially by an appropriate application technique such as injection or spray. A more preferred method is to form both the plugs and the hard third layers into a sheet that conforms to the array of depressions and covers the entire surface of the tile. This sheet would then be affixed to the tile with an appropriate adhesive or in the case of a thermoplastic sheet, heat and vacuum treatment for bonding to the tile.

The depressions 5 may have a depths of 5-70%, 10-60%, 20-50% of the thickness of the ceramic tile 2. The depths shall be understood to be the maximum orthogonal distance of a point on the inner surface of the depression from the plane of the relevant major surface.

The at least one depression filled with a second material and the rigid layer of a third material may be provided only on said first major surface of the ceramic tile, and not on the second major surface (i.e. the strike-face).

Figure 3:
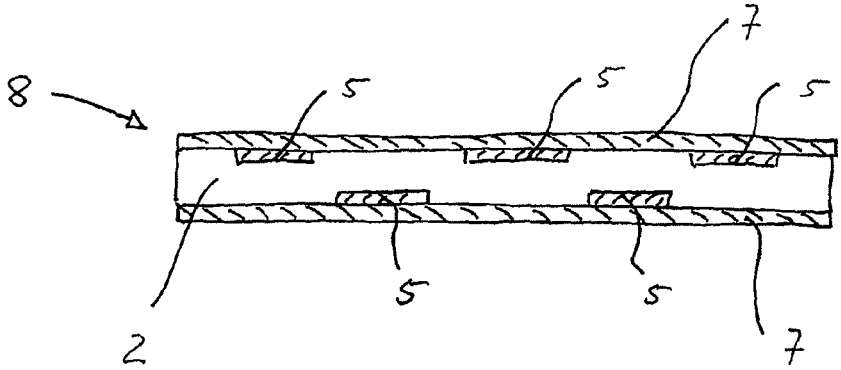
FIG. 3 shows a cross sectional view of an armor element of the invention with multiple depressions on both sides of the armor plate.

Referring to FIG. 3, however, the invention also relates to an armor 8 in which said at least one depression filled with a second material and said rigid layer 7 of a third material are provided on said first major surface 3 and on said second major surface 4 of ceramic tile 2.

The depressions are preferably distributed over said first major surface and/or over said second major surface in form of a regular lattice (i.e. at the points where lines of a regular lattice would intersect).

The present invention further relates to armor of the above described kind, wherein at least one further depression and a rigid layer of said third material is provided on one or more surfaces other than the first and second major surfaces, wherein said at least one further depression is at least partially filled with said second material.

Figure 5:
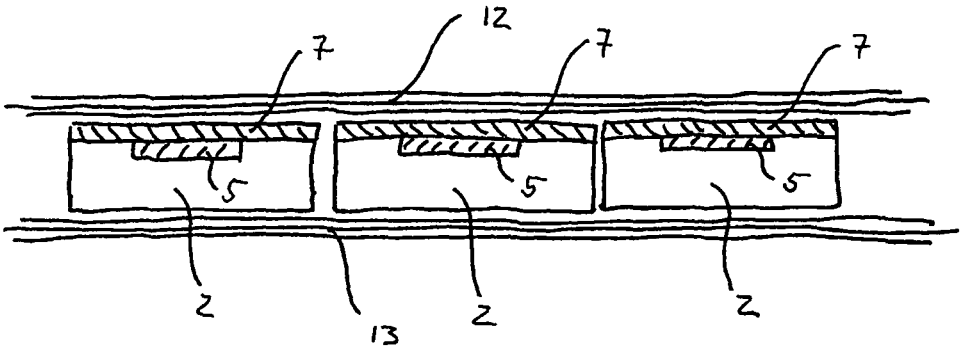
FIG. 5 shows an armor comprising multiple ceramic structures and layers of a flexible material.

Referring to FIG. 5, armor of the invention may have at least one layer of a flexible material 12, 13 in contact with said upper surface and/or with said lower surface of the armor. The armor may comprise at least one layer of a flexible material fixedly attached to said ceramic tile and/or to said rigid layer of a third material. The flexible material may comprise at least one of aramid fibers, polyethylene fibers, glass fibers, carbon fibers, liquid crystal polyester fibers, or synthetic fibers. The flexible material may also be a metal mesh. The flexible material may also be composite layerings of any of the above.

Figure 6:
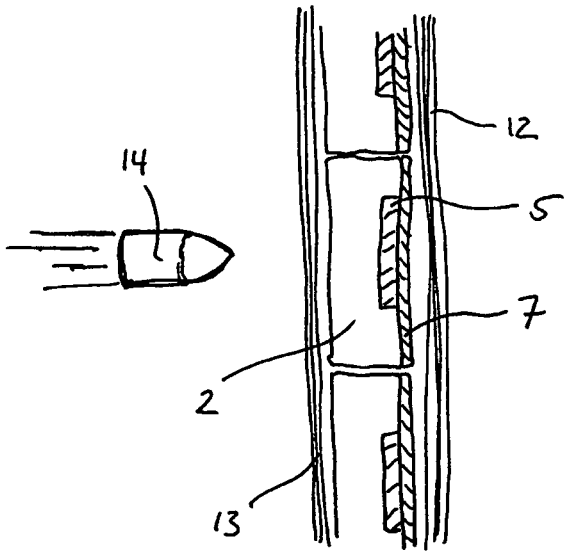
FIG. 6 shows a further embodiment of the invention.

FIG. 6 shows an armor of the invention and a bullet 14 at the side of the expected impact.

The at least one depression, according to the invention, may be of rectangular, quadratic, round, triangular, diamond, or hexagonal shape.

Figure 4:
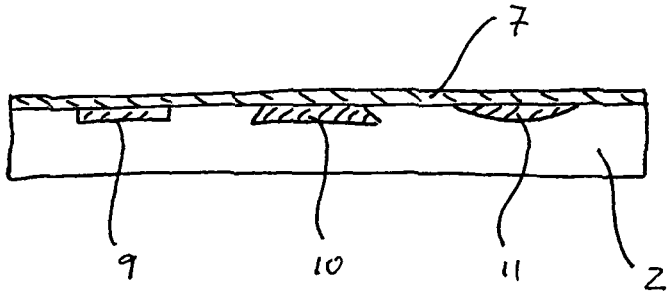
FIG. 4 shows depressions of various shapes.

With reference to FIG. 4, a depression of the invention may have a flat bottom as shown under reference numeral 9 and 10, or the depression may assume a spherical shape, as shown under reference numeral 11. Frustum shaped depressions, or truncated cones are also envisaged.

The at least one depression, according to the invention, may comprise a protrusion of said ceramic material.

The at least one depression, according to the invention, may be 0.5 to 30 mm, or 1.0 to 20 mm, or 1.0 to 10 mm, or 1.0 to 5 mm deep.

According to the invention, the least one depression may have a quadratic cross-sectional area with edges of 5 to 500 mm, or 10 to 300 mm, or 20 to 150 mm, or 30 to 75 mm in length. The at least one depression may also have an irregular shape with a longest diameter of 5 to 500 mm, 10 to 300 mm, 20 to 150 mm, or 30 to 75 mm in length. The longest diameter, in this context, is the largest distance between two points on the upper rim of the depression. Depressions may have a depth which is significantly smaller than at least its width or length or diameter. Preferably, the depth is 2, or 4, or 8, or 20, or 50 times smaller than any one of width, or length, or diameter of the depression.

Preferably, depressions are characterized by an absence of sharp intersections that concentrate stress waves within the ceramic material. Preferred depression geometry has a minimum of intersecting internal angles. A diamond depression with vertical walls is an example. More preferred depression geometries have angled internal walls. A diamond depression with 45 degree inclined walls is an example. Most preferred geometries have curved interior walls. A circular depression with sloping interior walls forming a progressively thinner web is an example. Examples of depression distribution include but are not limited to: circular depressions with multiple smaller depressions dispersed around the larger depression; circular depressions offset in rows and columns; circular depressions in rows and columns with triangular or diamond shaped depressions between said rows and columns; non-circular depressions arranged in a complementary fashion optimizing depression area; other depression distributions maximizing depression volume while maintaining desired structural and impact resistance.

Depressions may be directly opposite one another on parallel surfaces of the material forming a thin section or web between them. Depressions may be offset from one another on the first and second major surfaces of the tile so that the web is formed from more than two depressions on parallel surfaces. Depressions may be longitudinal, forming a channel in one or both parallel surfaces. These channel depressions may be discrete and separate from one another or multiple channels may intersect at any angle forming a larger depression.

Depressions may incorporate reinforcing structural features such as pillars or ridges or domes. These reinforcing projections may occur in one or more places within a given depression. Although these projections increase the surface area hence weight, they have a significant contribution in retaining the plug since surface area is increased perpendicular to the web.

According the invention, the tile may be of rectangular shape and may have a length of 1 to 50 cm and a width of 1 to 50 cm, or a length of 5 to 30 cm and a width of 5 to 30 cm, or a length of 8 to 20 cm and a width of 4 to 15 cm, or a length of 10 to 15 cm and a width of 8 to 12 cm.

Multiple ceramic tiles may be arranged in a two dimensional array of ceramic tiles. Preferably, the tiles would then be fixedly attached to a supporting layer of composite or metallic material to hold the multiple tiles in close proximity of each other. This ensures that gaps between the individual tiles are minimized. Multiple ceramic tiles may also be arranged in a three dimensional array of ceramic tiles. This provides for improved impact resistance of the armor. The multiple ceramic tiles can be connected by a composite or metallic supporting structure or completely encapsulated by said composite or metallic material providing necessary rigidity to the tile array.

The invention further relates to a personal armor, a ship, an aircraft or to a vehicle comprising an armor as described above. Also buildings comprising an armor of the invention are envisaged.

Example 1

An armor plate with overall dimensions of 25 cm square was constructed of 97% pure alumina oxide ceramic tiles, 8 mm thick and 50 mm square which were reduced in thickness on both the first and second major surfaces directly opposite each other and the depressions were filled with a high-strength epoxy, which was considered appropriate for the expected threat of the 7.62 mm NATO Ball Type MEN projectile (a non-armor-piercing lead bullet). The ceramic tiles measured between 3.9-4.5 mm at the thinnest sections at the depressions. The tiles were consolidated on a rigid woven stainless steel mesh of 2.3 kg per square meter on the second major surface which rendered the array of tiles stiff and inflexible providing the necessary rigidity for high velocity impacts. A rigid third material of woven stainless steel mesh of 1.3 kg per square meter was applied to the first major surface to seal the epoxy material. The plate was given a primary composite backing of 6 layers of laminated aramid fabric and a second removable aramid composite of equivalent construction which was removed upon observation of the plates' resistance after the first shot. The square meter areal weight of this composite was 6.5 kg which is consistent with state-of-the-art aramid composite backings for ceramic plates of full thickness (8 mm) designed to resist the specific projectile tested.

All shots but one were placed in the thinnest sections of the tile (i.e. at the sites of the depressions). After five (5) shots impacted the plate, the primary composite backing has deformed to such a degree that further shots would not be a reliable indicator of the plates capabilities so the optional secondary backing was added to continue testing. It must be noted here that in current state-of-the-art ceramic plates against this threat, employing a maximum ceramic thickness of 4.5 mm requires that an aramid composite backing of eleven to thirteen kilograms per square meter is employed behind the plate for reliable performance. It can be seen that the invention was successful in stopping the threat with little more than half the thickness of conventional plates (8 mm ceramic thickness) and a composite backing weight at half of the current state-of-the-art for ceramic plates of 4.5 mm. What is also evident in this test is the extreme efficiency of this invention in defeating multiple impacts. Current specifications such as USNIJ 0101.04 Rev. A require a maximum of 6 shots on a plate of dimensions 254 mm×305 mm with no penetrations. The test plate of 250 mm×250 mm exhibited an ability to reliably defeat ten (10) shots.

One finds that a ceramic armor can be constructed of reduced thickness of the ceramic layer with less backing material that reliably defeats the USNIJ Level III threat and provides an improved ability to defeat multiple impacts.

Conditions of the test were in conformance to International Standards with velocity measurements, distance to target, bullet construction, plastilina block for shock determination, and a standard soft-body armor vest panel of USNIJ Level II all precisely monitored and measured.

TABLE 1

Test results using 7, 62 × 51 Men bullet (lead bullet).

| Shot | Impact m/s | Stop/Perforation | Observation | Total Backing Layers |
|---|---|---|---|---|
| 1 | 833 | Stop | in the first 6 layers | 12 |
| 2 | 840 | Stop | in the last layer | 6 |
| 3 | 844 | Stop | in the last layer | 6 |
| 4 | 842 | Stop | in the last layer | 6 |
| 5 | 839 | Stop | in the vest | 6 |
| 6 | 841 | Stop | in the last layer | 12 |
| 7 | 837 | Stop | in the last 6 layers | 12 |
| 8 | 840 | Stop | in the last 6 layers | 12 |
| 9 | 840 | Stop | in the last 6 layers | 12 |
| 10 | 844 | Stop | in the vest | 12 |

Example 2

An armor plate with overall dimensions of 25 cm square was constructed of 97% pure alumina oxide ceramic tiles, 10 mm thick and 50 mm square which were reduced in thickness on the first major surfaces and the depressions were filled with a composite material incorporating multiple layers of metallic mesh, non-woven fabrics, aluminum alloys and consolidated with high-strength epoxy, which was considered appropriate for the expected threat of the 7.62 mm NATO AP (Armor-Piercing) Type P80 projectile. The ceramic tiles measured between 6.0 and 6.5 mm at the thinnest sections at the depressions. The tiles were consolidated on a third material of a rigid woven stainless steel mesh of 900 grams per square meter and multiple layers of fiberglass fabric on the second major surface which rendered the array of tiles stiff and inflexible providing the necessary rigidity for high velocity impacts. Again, an extreme efficiency in defeating multiple impacts was observed. Current specifications such as USNIJ 0101.04 Rev. A require a maximum of 1 shot on a plate of dimensions 254 mm×305 mm with no penetration. The test plate of 250 mm×250 mm exhibited an ability to reliably defeat eight (8) shots.

One finds that a ceramic armor can be constructed of reduced thickness of the ceramic layer with less backing material that reliably defeats the NATO Armor-Piercing threat and provides a significantly greater ability to defeat multiple impacts.

Conditions of the test were in conformance to International Standards with velocity measurements, distance to target, bullet construction, plastilina block for shock determination, and a standard soft-body armor vest panel of USNIJ Level II.

This example employs cavities on the non-strike face of 5 cm square tiles where the third material is adhered both to the ceramic sealing the second material within, and to the pressed polyethylene laminate backing material. The weight of the ceramic tiles including second material and the layer of 3rd material was 2.8 kg thereby a square meter weight of 44.8 kg per square meter was achieved.

TABLE 2

| Shot | Impact m/s | Stop/Perforation | Observation | 2ndnd Material |
|---|---|---|---|---|
| 1 | 805 | Stop | Stop on first layer of laminate backing material | Composite |
| 2 | 822 | Stop | Stop on first layer of laminate backing material | Composite |
| 3 | 819 | Stop | Stop on first layer of laminate backing material | Composite |
| 4 | 826 | Stop | Stop in third material | Composite |
| 5 | 823 | Stop | Stop in third material | Composite |
| 6 | 827 | Stop | Stop in third material | Composite |
| 7 | 828 | Stop | Stop on first layer of laminate backing material | Composite |
| 8 | 820 | Stop | Stop on first layer of laminate backing material | Composite |

Example 3

An armor plate with overall dimensions of 25 cm square was constructed of 97% pure alumina oxide ceramic tiles, 10 mm thick and 50 mm square which were reduced in thickness on the first major surfaces and the depressions were filled with a composite material incorporating composite elements of chopped fiberglass and fiberglass fabrics and consolidated with high-strength epoxy, which was considered appropriate for the expected threat of the 7.62 mm NATO AP (Armor-Piercing) Type P80 projectile. The ceramic tile measured between 6.0 and 6.5 mm at the thinnest sections at the depressions. The tiles were consolidated on a third material of a rigid woven stainless steel mesh of 900 grams per square meter and multiple layers of fiberglass fabric on the second major surface which rendered the array of tiles stiff and inflexible providing the necessary rigidity for high velocity impacts. The same extreme efficiency of this invention in defeating multiple impacts was observed. Current specifications such as USNIJ 0101.04 Rev. A require a maximum of 1 shot on a plate of dimensions 254 mm×305 mm with no penetration. The test plate of 250 mm×250 mm exhibited an ability to reliably defeat seven (7) shots.

One finds that a ceramic armor can be constructed of reduced thickness of the ceramic layer with less backing material that reliably defeats the NATO Armor-Piercing threat and provides a significantly greater ability to defeat multiple impacts.

Conditions of the test were in conformance to International Standards with velocity measurements, distance to target, bullet construction, plastilina block for shock determination, and a standard soft-body armor vest panel of USNIJ Level II all precisely monitored and measured.

The example employs cavities on the non-strike face of 5 cm square tiles where the third material is adhered both to the ceramic sealing the second material within, and to the pressed polyethylene laminate backing material. The weight of the ceramic tiles including second material and the layer of 3rd material was 2.5 Kilos thereby a square meter weight of 40.0 Kilos per square meter was achieved.

TABLE 3

| Shot | Impact m/s | Stop/Perforation | Observation | $2^{nd}$nd Material |
|---|---|---|---|---|
| 1 | 825 | Stop | Stop on first layer of laminate backing material | Composite |
| 2 | 833 | Stop | Stop on first layer of laminate backing material | Composite |
| 3 | 819 | Stop | Stop in rear surface of third ($3^{rd}$) material | Composite |
| 4 | 828 | Stop | Stop on first layer of laminate backing material | Composite |
| 5 | 831 | Stop | Stop on first layer of laminate backing material | Composite |
| 6 | 825 | Stop | Stop in rear surface of third ($3^{rd}$) material | Composite |
| 7 | 828 | Stop | Stop on first layer of laminate backing material | Composite |

Example 4

A control experiment was conducted for examples 2 and 3: 10 mm Alumina oxide ceramic tiles on identical laminate were used. A 10 kg/square meter pressed polyethylene backing laminate with a total target weight of 48.0 kg per square meter was applied. Test results are given in Table 4. Only a single bullet was stopped. A second bullet completely perforated the ceramic tile and the backing laminate.

TABLE 4

| Shot | Impact m/s | Stop/Perforation | Observation | Control Panel |
|---|---|---|---|---|
| 1 | 822 | Stop | Stop on first layer of laminate backing material | |
| 2 | 827 | Perforation | Complete Perforation of ceramic & laminate | |

The invention claimed is:

1. Armor comprising a ceramic tile, said ceramic tile having a first major surface and a second major surface, said first and second major surfaces being substantially flat surfaces and parallel to each other, said ceramic tile further having at least one depression in said first major surface, said depression being at least partially filled with a second material, said armor further comprising a rigid layer of a third material, said rigid layer being fixedly attached to said first major surface of said ceramic tile and contacting said second material, so as to seal said second material between said ceramic tile and said rigid layer, wherein said second major surface is at the strike-face of the armor.

2. Armor of claim 1, wherein said tile has multiple such depressions in said first major surface.

3. Armor of claim 1, wherein said ceramic material is selected from the list consisting of alumina oxide, boron carbide, silicon carbide, glass ceramics, cermets, titanium diboride, silicon oxide, silicon nitride, silicon aluminum oxynitride, aluminum nitride and transformation toughened zirconium dioxide.

4. Armor of claim 1, wherein said second material has a specific weight smaller than that of the ceramic material.

5. Armor of claim 1, wherein said second material is a polyepoxide, polyether-ether-ketone, a polycarbonate, a lightweight metal, a composite or a liquid crystal polyester.

6. Armor of claim 1, wherein said third material is a metallic film, a metallic sheet, or a thermoplastic layer, or thermoset plastic layer, or a composite material, or a fibrous material.

7. Armor of claim 1, wherein said second material is fixedly attached to said ceramic material and to said rigid layer of a third material.

8. Armor of claim 1, wherein said depressions have a depth of 5-70% of the thickness of the ceramic tile.

9. Armor of claim 1, wherein said at least one depression and said rigid layer of a third material is provided on said first and on said second major surface of the ceramic tile.

10. Armor of claim 1, further comprising at least one layer of a flexible material fixedly attached to said ceramic tile or to said rigid layer of a third material.

11. Armor according to claim 1, wherein said at least one depression is a spherical depression.

12. Armor according to claim 1, wherein multiple ceramic tiles are arranged in a two dimensional array or in a three dimensional array.

13. An object comprising an armor of claim 1, wherein said object is a vehicle, a building, a ship or an aircraft.

14. Method of protecting an object with an armor of claim 1, wherein said armor is arranged such that said second major surface of said tile is at the strike-face of the armor.

15. Method of claim 14, wherein said tile has multiple such depressions in said first major surface.

16. Armor of claim 1, wherein said depressions have a depth of 10-60% of the thickness of the ceramic tile.

17. Armor of claim 1, wherein said depressions have a depth of 20-50% of the thickness of the ceramic tile.

18. A method of making protection armor, comprising arranging in said armor a ceramic tile, said ceramic tile having a first major surface and a second major surface, said ceramic tile further having at least one depression in said first major surface, said depression being at least partially filled with a second material, said armor further comprising a rigid layer of a third material, said rigid layer being fixedly attached to said first major surface of said ceramic tile and contacting said second material, so as to seal said second material between said ceramic tile and said rigid layer, wherein said tile is arranged such that its second major surface is at the strike-face of said armor.

19. The method of claim 18, wherein said ceramic tile has multiple said depressions in said first major surface.

* * * * *

UNITED STATES PATENT AND TRADEMARK OFFICE

CERTIFICATE OF CORRECTION

PATENT NO. : 8,646,371 B2
APPLICATION NO. : 12/808804
DATED : February 11, 2014
INVENTOR(S) : Stephen Fisher It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 348 days.

Signed and Sealed this
Twenty-ninth Day of September, 2015

Michelle K. Lee

Michelle K. Lee
*Director of the United States Patent and Trademark Office*